US011779988B2

(12) United States Patent
Lozano Bonet

(10) Patent No.: US 11,779,988 B2
(45) Date of Patent: Oct. 10, 2023

(54) FINE BLANKING SYSTEM AND METHOD OF OPERATING

(71) Applicant: Lapmaster Wolters GmbH, Rendsburg (DE)

(72) Inventor: Jose Lozano Bonet, Rendsburg (DE)

(73) Assignee: Lapmaster Wolters GmbH, Rendsburg (DE)

( * ) Notice: Subject to any disclaimer, the term of this patent is extended or adjusted under 35 U.S.C. 154(b) by 0 days.

(21) Appl. No.: 16/867,044

(22) Filed: May 5, 2020

(65) Prior Publication Data

US 2020/0353528 A1 Nov. 12, 2020

(30) Foreign Application Priority Data

May 6, 2019 (EP) ..... 19172772

(51) Int. Cl.
*B21D 28/26* (2006.01)
*B26F 1/14* (2006.01)

(52) U.S. Cl.
CPC ..... *B21D 28/26* (2013.01); *B26F 1/14* (2013.01)

(58) Field of Classification Search
CPC ..... B21D 28/26; B21D 28/002; B21D 28/16; B26F 1/14
USPC ..... 83/55, 621–622
See application file for complete search history.

(56) References Cited

U.S. PATENT DOCUMENTS 3,473,427 A * 10/1969 Leibinger ..... B23D 15/02 83/699.41
4,893,536 A * 1/1990 Kinoshita ..... B21D 28/16 83/699.41
5,413,018 A * 5/1995 Wada ..... B26D 5/086 83/466
5,787,775 A * 8/1998 Stevens ..... B21D 28/12 83/34
8,141,482 B2 * 3/2012 Schaltegger ..... B30B 15/0029 100/257
8,156,780 B2 4/2012 Fellenberg et al.
9,566,635 B2 * 2/2017 Ochsenbein ..... B21D 28/20
10,081,046 B2 * 9/2018 Honegger ..... B30B 1/323
2008/0092711 A1 * 4/2008 Thielges ..... B21D 22/08 83/552
2011/0000349 A1 * 1/2011 Schaltegger ..... B30B 15/0029 83/55
2016/0038991 A1 * 2/2016 Hofer ..... B21D 28/16 72/338

(Continued)

FOREIGN PATENT DOCUMENTS

CN 201056061 Y * 5/2008
CN 103496185 A 1/2014

(Continued)

OTHER PUBLICATIONS

Translation of CN 109013835 (Year: 2023).*

(Continued)

*Primary Examiner* — Nhat Chieu Q Do
(74) *Attorney, Agent, or Firm* — Barclay Damon LLP

(57) ABSTRACT

A fine blanking system comprises one or more movable parts, further comprises at least one first drive of a first drive type and at least one second drive of a second drive type different from the first drive type for driving at least one of the movable parts, wherein the first drive and the second drive are arranged to drive the same movable part.

13 Claims, 1 Drawing Sheet

(56) References Cited

U.S. PATENT DOCUMENTS

| | | | | |
|---|---|---|---|---|
| 2017/0008062 | A1* | 1/2017 | Honegger | B30B 1/323 |
| 2018/0141101 | A1* | 5/2018 | Sumida | B21D 28/16 |

FOREIGN PATENT DOCUMENTS

| | | | | | |
|---|---|---|---|---|---|
| CN | 109013835 | A | * | 12/2018 | |
| DE | 19642635 | A1 | * | 10/1997 | B21D 28/16 |
| DE | 102004049149 | A1 | | 4/2006 | |
| DE | 102014214739 | B3 | | 12/2015 | |
| EP | 1593444 | A1 | | 11/2005 | |
| EP | 2159982 | A1 | | 3/2010 | |
| EP | 3115191 | A1 | | 1/2017 | |
| EP | 3593919 | A1 | | 1/2020 | |
| JP | 2006255740 | A | * | 9/2006 | |
| KR | 100723623 | B1 | | 5/2007 | |
| WO | WO-0100396 | A2 | * | 1/2001 | B21D 28/16 |
| WO | 2009062058 | A1 | | 5/2009 | |

OTHER PUBLICATIONS

Translation of CN 201056061Y (Year: 2023).*
Translation of DE 19642635 A1 (Year: 2023).*
EP 19 172 772.6; filed May 6, 2019; EP Office Action dated Dec. 9, 2022 (5 pages).
CN 202010370547; filed May 6, 2020I CN Office Action dated Dec. 27, 2022 (12 pages).

* cited by examiner

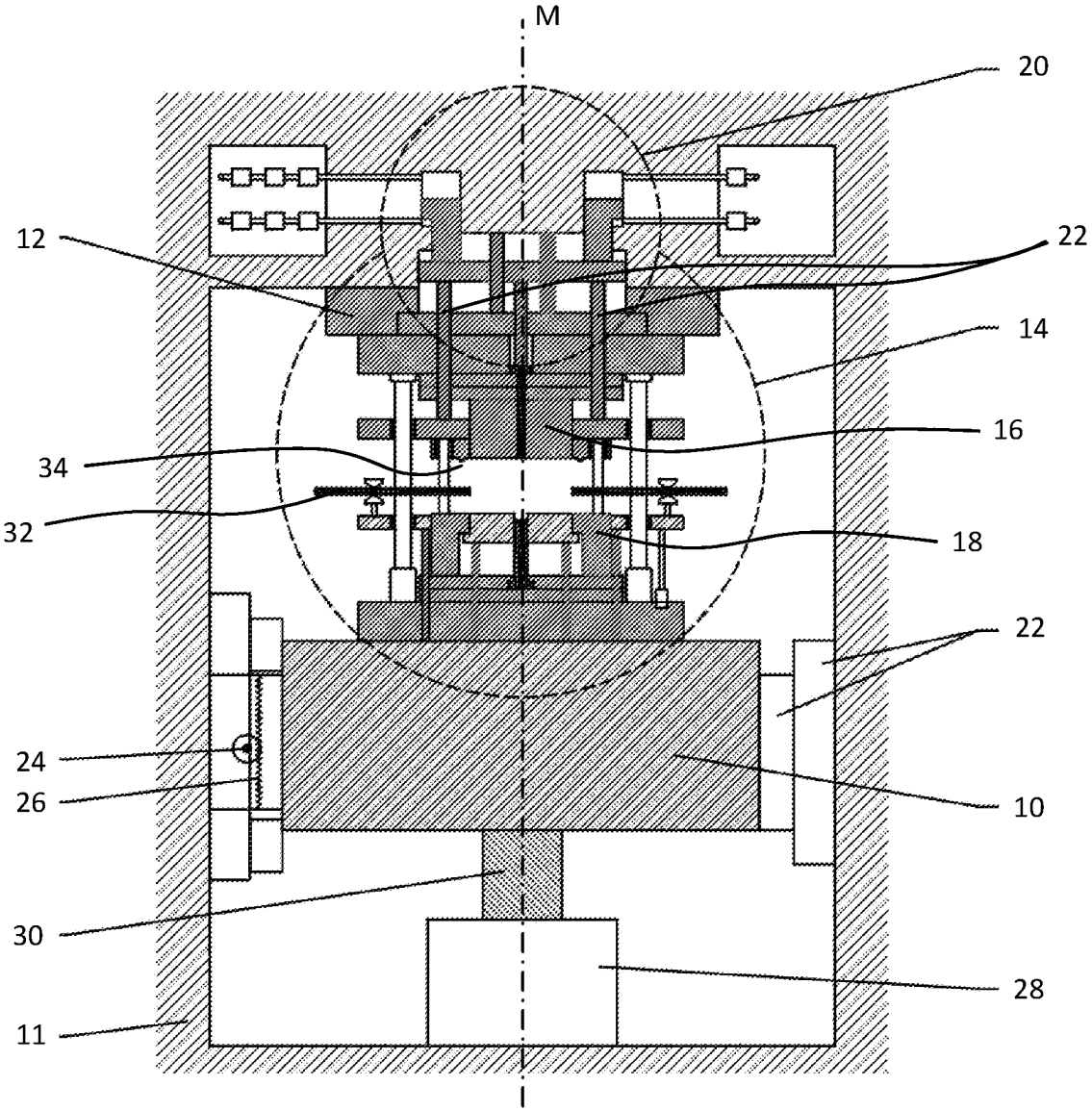
20
22
14
16
18
22
10
28
M
12
34
32
24
26
30
11

FINE BLANKING SYSTEM AND METHOD OF OPERATING

CROSS REFERENCE TO RELATED INVENTION

This application is based upon and claims priority to, under relevant sections of 35 U.S.C. § 119, European Patent Application No. 19 172 772.6, filed May 6, 2019, the entire contents of which are hereby incorporated by reference.

BACKGROUND

The invention pertains to a fine blanking system as well as to a method for operating such a fine blanking system. Such fine blanking systems usually comprise at least one fine blanking press, which allows for blanking parts for example from sheet metal with high quality and flexibility with regard to the design of the parts. Fine blanking presses usually comprise a press ram and a counter unit, such as a working table, arranged opposite the press ram. A blanking tool is arranged between the blanking ram and the working table. The blanking tool can comprise for example one or more press plates or ejectors directly connected by transfer pins to a press cushion of the press ram or a press cushion of the working table or connected to any other cushion or actuator integrated inside the tool itself, as well as one or more press punches or press dies. During a fine blanking process step the press ram is driven in a driving movement against the working table wherein sheet metal to be processed is held between the press ram and the working table.

During the fine blanking process step the press ram pushes the working table along its driving direction. During the fine blanking process step the press ram can move relative to press plates or press punches, press dies or others. For blanking a part from the process material for example, press punches can move relative to the press ram. Usually, the blanking tool is provided with impingement means, for example an impingement ring, like a V-ring, for securely holding the process material in place. The fine blanking process can also comprise progressive, transfer, rotary or other tooling process steps, wherein a part is blanked performing subsequent movements of press ram and working table. Fine blanking presses are known for example from EP 2 158 982 A1 or EP 3 115 191 A1.

Also, such fine blanking systems may comprise one or more other components as for example but not limited to, feeding devices, washing devices, packaging devices, and/or quality inspection devices. Such a feeding device, for example, may be arranged upstream of the fine blanking press with respect to a material feeding direction and may feed said sheet metal to be processed into the fine blanking press for subsequent pressing. Such a washing device as well as the packaging device and the quality inspection device may be arranged downstream of the fine blanking press with respect to said material feeding direction and may provide for washing, packaging and the quality inspection of the processed sheet metal.

The at least one fine blanking press as well as the one or more other components can comprise one or more movable parts which are driven by one or more drives. Regarding the fine blanking press, for example, the press ram exerting the main blanking force on the sheet metal can be driven as a movable part by a hydraulic cylinder as a drive. During its driving movement the press ram can drive other press units, such as cushions. The cushions can also be provided with a hydraulic cylinder which may be actuated by the movement of the press ram. In known fine blanking presses, accumulators, such as gas cylinders filled with for example nitrogen, are provided, wherein an actuation of the hydraulic cylinder of the cushion during the driving movement of the press ram compresses the gas in the accumulator. In this way part of the energy applied during the fine blanking process can be collected and used for the next press cycle. This makes the fine blanking press energy efficient. Regarding the one or more other components, the feeding device, for example, may comprise one or more feeding rollers as moveable parts which may me driven by, for example, an electrical motor.

Fine blanking systems may use drives of different drive types, e.g. electrical drives and hydraulic drives, or of the same drive type, e.g. only electrical drives, to drive different movable parts of the system and therefore fulfill different functions, e.g. feeding and pressing. For example, a mechanical fine blanking press may comprise a press ram as a first movable part being driven by an electrical drive as a first drive. The electrical drive may be connected to a crankshaft which in turn may be connected to the press ram by one or more connecting rods. The electrical drive may drive the press ram up and down along a movement axis with a controlled speed and force via the crankshaft and the connecting rods during the fine blanking process thereby providing the blanking force needed to process the sheet metal. Into the press ram a cushion may be integrated forming a second movable part wherein a hydraulic drive as a second drive acts on said cushion. The hydraulic drive may drive the cushion up and down along the movement axis in order to provide counter forces, e.g. via a V-ring, to counter the press forces exerted by the electrical drive via the ram and to hold the sheet metal in place. Also, the hydraulic drive may eject the processed sheet metal after the fine blanking step. Thus, at least two drives of different types are used to fulfill different functions. Instead of a mechanical fine blanking press a hydraulic fine blanking press may be used wherein instead of the electrical drive a hydraulic drive is used for driving the press ram. In this case, at least two drives of the same drive type are provided fulfilling different functions.

Mechanical fine blanking presses are the fastest in the market with respect to the numbers of cycles and therefore blanked parts per time unit but they can only provide a limited pressing force mainly due to the electrical drive drives driving the press ram. They are mostly used for the production of small to medium sized blanked parts as high press forces are not required in this case. Hydraulic fine blanking presses on the other hand can provide much larger pressing forces due to their hydraulic drives driving the press ram which makes them suitable for all sizes of blanked parts. However, due to the hydraulic drives and in particular the heavy design necessitated by the hydraulic drives such hydraulic presses are very limited in their production speeds.

A new concept of fine blanking presses emerged called servo presses in which at least one actuator is powered by a servo motor. Thus, at least one moveable part, for example the press ram, is driven by a servo motor drive. However, even these servo presses—as specific types of mechanical fine blanking presses being driven by an electrical drive—do not fulfill market requirements with respect to production speeds and blanking force.

Starting from the above explained prior art it is an object of the invention to provide a fine blanking system and a method for operation of the same which allow for high production speeds and high forces.

BRIEF SUMMARY OF THE INVENTION

An embodiment of a fine blanking system comprises one or more movable parts, at least one first drive of a first drive type and at least one second drive of a second drive type different from the first drive type for driving at least one of the movable parts. The first drive and the second drive are arranged to drive the same movable part.

An embodiment of a method for operating a fine blanking system comprising one or more movable parts is disclosed. The method comprises the steps of driving at least one of the movable parts via at least one first drive of a first drive type, and driving the same movable part via at least one second drive of a second drive type different from the first drive type.

The invention and embodiments of the invention disclosed herein pertain to the inventive fine blanking system as well as to the inventive method of operating the fine blanking system.

In an embodiment, multiple drives of different drive types drive the same movable part. For example, the fine blanking system can comprise two, three or any greater number of drives. Of these drives at least two are of different drive types and are arranged to drive the same moveable part. Also, three or more or in particular all of the drives of the fine blanking system may be of different types and/or may drive the same moveable part. In addition to the at least two drives of different drive types, further drives may be provided of the same or of different drive types driving the same moveable part or different movable parts. The drive types in particular pertain to the technology of energy transfer. Thus, the drives may differ in their energy transfer technology. Such technologies may be, for example, electrical, mechanical, hydraulic or pneumatic energy transfer. The at least one first drive may e.g. be an electrical drive and the at least one second drive e.g. a hydraulic drive. According to an embodiment, the first drive type and/or the second drive type is selected from the group comprising, but not limited to: electrical drive, magnetic drive, hydraulic drive, mechanical drive, pneumatic drive. Thus, the at least two drives of different drive types may each be selected from said group. As mentioned, one or more additional drives may be provided driving the same or different parts each being selected from said group. However, the different drive types may also use the same energy transfer technology but may instead differ with respect to the movement principle of the respective drive. The movement principle may be, for example, a linear movement or a rotational movement. For example, the at least two drives may both be electrical drives wherein one of the drives is a rotational motor drive, in particular a servo motor drive, and the other is a linear drive. The electrical energy would then be converted in a linear movement or in a rotational movement respectively.

The at least two drives of different drive types are configured to drive the same moveable part. In particular, each of the drives acts not via one of the other drives but directly on the same moveable part. The at least one first drive and the at least one second drive may be configured to independently from one another drive the same movable part. However, the drives may instead be coordinated or synchronized in some manner, in particular to generate a smooth movement. Also, the at least two drives of different drive types may be are arranged to separately drive the same movable part. For example, in a first movement step only the first drive may be actively driving the moveable part while the second drive is idle. Subsequently, for example, only the second drive may be actively driving the moveable part during a second movement step while the first drive is idle. Nevertheless the at least one first drive and the at least one second drive may jointly drive the same moveable part at the same time. Thus, the method steps of the inventive method may be executed in succession or in parallel. In particular, the same movable part may be driven separately and/or jointly via the at least one first drive and via the at least one second drive.

Providing multiple drives of different drive types to drive the same movable part allows for a productive combination of the different drive types. Each of the drives of different types may play out its advantages allowing for high production speeds and high pressing forces. Thus, the proposed fine blanking system is able to fulfill the market requirements with respect to production speeds and blanking force. This will be explained in more detail in the following for a fine blanking press. However, the invention is not limited to fine blanking presses but may also pertain to other components of a fine blanking system.

The fine blanking system may in particular comprise at least one fine blanking press, wherein the at least one movable part is part of the at least one fine blanking press. The fine blanking press may comprise at least one first press unit as a movable part and further at least one second press unit, wherein the at least one first drive is a first press drive and the at least one second drive is a second press drive for driving the at least one first press unit in a driving movement against the at least one second press unit along a movement axis. The at least one fine blanking press may comprise one or more first press units, such as one or more press rams, one or more press cushions and/or one or more chopping units and/or others, and one or more second press units, such as one or more press counter rams, one or more working tables, one or more press cushions and/or one or more press plates, and/or others. Opposite the first press unit, for example such as a press ram, for example a working table can be arranged.

The first press unit may carry out different movements, for example a first fast approaching movement, a second blanking or cutting movement and a third return movement. Additional movements with different movement speeds may be introduced for example in between the explained movements. The process material may be clamped by means of a fine blanking tool arranged between for example the press ram and a working table arranged opposite the press ram. The fine blanking tool serves to blank parts out of the process material fed to the process zone between the press ram and the working table, and can comprise one or more press punches, dies or other components. For example in the press two or more cushions can be arranged opposite each other. One of the cushions can comprise impingement means, such as an impingement ring, like a V-shaped ring (V-ring), for securely holding the process material during the blanking process. Press punches movable relative to the cushions can be provided for blanking parts out of the process material. A feeding device can be provided as part of the fine blanking system which feeds the process material to be processed into the process zone between the press ram and the working table. The process material is typically sheet metal. It can be present as a coil that is unwound from a reel and fed flat to the process zone, where it is blanked by the blanking tool.

In an embodiment, the at least one fine blanking press may, for example, comprise a press ram as a first movable part, an electrical drive as a first drive and a hydraulic drive as a second drive wherein the press ram is driven not only by the electrical drive but also by the hydraulic drive. The electrical drive may, for example, drive the press ram up and down along a first part of the movement axis at a relatively high speed but with a relatively low force thereby approaching the sheet metal while the hydraulic drive may, for example, drive the press ram down along a second part of the movement axis at a relatively low speed but with a relatively high force thereby blanking the sheet metal. Thus, the at least two drives of different types fulfill the same function: they drive/move the press ram. In this way the press ram can be moved quickly and efficiently by the electrical drive when no large forces are needed while the press ram can be driven with a high force when the pressing step is carried out. In this manner the inventive system and method allow for a combination of the advantages of the mechanical fine blanking presses and the hydraulic fine blanking presses explained in the introduction. High production speeds and high pressing forces can be accomplished.

As drives of different drive types are used to drive the same moving part, one could speak of a "hybrid actuator". The fine blanking system may thus be understood as a "hybrid system". In particular, the at least one fine blanking press may be considered a "hybrid press" in that it comprises at least one hybrid actuator. As mentioned, due to said hybrid actuator the hybrid press is able to fulfil the market requirements with respect to production speeds and blanking force.

According to an embodiment, the first drive is configured to drive the at least one movable part at a first rate and the second drive is configured to drive the at least one moving part at a second rate. The first rate and the second rate comprise at least one of a speed, an acceleration and a force. In an embodiment, the first speed, acceleration and/or force is different from the second speed, acceleration and/or force. In particular, the second speed, acceleration and/or force may be smaller than the first speed, acceleration and/or force. As mentioned above, for example, the press ram can be driven at a higher speed towards the sheet metal via an electrical drive while the pressing step can be carried out by moving the press ram at a lower speed but higher force via the hydraulic drive.

According to an embodiment, and as mentioned above, the fine blanking system comprises at least one fine blanking press, wherein the at least one fine blanking press comprises at least one first press unit as a movable part and further at least one second press unit, wherein the at least one first drive is a first press drive and the at least one second drive is a second press drive for driving the at least one first press unit in a driving movement against the at least one second press unit along a movement axis. According to a further embodiment, the first press drive is arranged to drive the at least one first press unit along a first part of the movement axis in order for the at least one first press unit to approach the at least one second press unit and wherein the second press drive is arranged to drive the at least one first press unit along a second part of the movement axis subsequent to the first part in order for the at least one first press unit to fine blank a work piece arranged between at least one first press unit and the at least one second press unit. According to a further embodiment, the first press drive is also arranged to drive the at least one first press unit in the opposite direction along the first part and/or the second part of the movement axis in order for the at least one first press unit to withdraw from the at least one second press unit. According to a further embodiment, the first press drive is an electrical drive, in particular but not limited to an electrical linear drive or a servo motor drive, and the second press drive is a hydraulic drive. According to a further embodiment the at least one first press unit and/or the at least one second press unit is selected from the group comprising, but not limited to: press rams, working tables, press cushions, press plates and/or chopping units. As mentioned above, the at least one first press unit can be a press ram being moved by an electrical drive as a first drive along the first part of the movement axis to approach the at least one second press unit, which may be the working table holding the sheet metal, wherein as a second press drive a hydraulic drive may be arranged to drive the press ram along the second part of the movement axis subsequent to the first part in order for the press ram to fine blank a work piece arranged between press ram and the working table.

According to an embodiment, the other components of the fine blanking system are selected from the group comprising, but not limited to: feeding devices, levelling devices, grinding devices, surface treatment devices, press devices, fine blanking presses, parts feeding devices, deburring devices, washing devices, tumbler devices, assembling devices, robot devices, handling devices, packaging devices, labelling devices and/or quality inspection devices. As mentioned above, the invention is not limited to fine blanking presses but may also be of use for said other components of the fine blanking system.

According to an embodiment, the at least one first drive and the at least one second drive are arranged to independently from one another drive the same movable part. According to an embodiment, the at least one first drive and the at least one second drive are arranged to separately and/or jointly drive the same movable part. As mentioned above, the at least two drives of different drive types can drive the same moveable part separately from one another, in particular in succession. As also mentioned, the can also drive the moveable part jointly. In both cases the moveable part may be driven independently by the drives. However, the drives may also dependently from one another drive the moveable part; in particular they can be synchronized. In particular, with respect to the embodiment explained in detail above, the press ram of the fine blanking press may be moved by the electrical drive and the hydraulic drive not only successively but also jointly along the movement axis. For example, the hydraulic drive can be supported by the electrical drive in driving the press ram along the second part of the movement axis and therefore in the fine blanking step.

The inventive method may be carried out using the inventive fine blanking system. Correspondingly, the inventive fine blanking system, and in particular the fine blanking press, can be designed to carry out the inventive method, in particular the above embodiments.

BRIEF DESCRIPTION OF THE DRAWINGS

An embodiment of the invention is explained in the following by reference to a schematic drawing.

FIG. 1 illustrates a schematic view of an embodiment of a fine blanking press of a fine blanking system.

DETAILED DESCRIPTION OF THE INVENTION

The fine blanking press according to the invention shown in FIG. 1 comprises a press frame 11, a press ram 10, constituting a first press unit, and a working table 12, constituting a second press unit, arranged opposite the press ram 10. Between the press ram 10 and the working table 12 a fine blanking tool 14 is arranged comprising a press punch 16, which may be positionally fixed together with the working table 12, and a die 18 which moves together with the press ram 10. A table cushion 20 is connected to the working table 12 via transfer pins 22. The table cushion 20 and thus the working table 12 are actuated by a hydraulic drive arranged in the upper part of the press frame 11. An electrical drive 24, in particular a servo motor, is provided as a first press drive and acts on the press ram via a transmission 26 for driving the press ram 10 along a movement axis M. In addition, a hydraulic drive 28 is provided in the lower part of the press frame 11 acting on the press ram 10 via a piston rod 30 for driving the press ram 10 along the movement axis M.

During a fine blanking process step the press ram 10 is moved up and down along the movement axis M. In a first movement step the press ram 10 is driven along a first part of the movement axis M via the electrical drive 24 at a relatively high speed but with relatively low force. In this way the press ram 10 approaches a sheet metal 32 arranged in a process zone between the press ram 10 and the working table 12. In a second movement step the press ram 10 is driven along a second part of the movement axis M subsequent to the first part via the hydraulic drive 28 at a relatively low speed but with relatively high force. During this movement the punch 16 and die 18 blank parts out of the sheet metal 32.

An impingement ring 34, like a V-ring, is further shown schematically for securely holding the process material 32 during the fine blanking process. The impingement ring 34 may in particular be provided on a press plate of the blanking tool driven by the cushion 20. While moving the press ram 10 also the table cushion 20 may be moved down along the movement axis M in order to provide counter forces on the sheet metal 32 via the impingement ring 34 to counter the press forces exerted by the electrical drive via the press ram 10 and to hold the sheet metal 32 in place. Also, the table cushion 20 may eject the processed sheet metal after the fine blanking step.

After the parts have been blanked out the press ram 10 is withdrawn from the working table 12 along the whole movement axis M, i.e. along the first part and the second part, by the electrical drive 24 at again with relatively high speed and relatively low force.

The press ram 10 is thus driven by two separate drives of different drive types, one electrical and one hydraulic. The electrical drive and the hydraulic drive are configured to drive the press ram 10 separately or independently from one another as explained above. However, these drives can also be arranged to jointly move the press ram 10. For example, the press ram 10 can be driven towards the working table along the second part of the movement axis, i.e. the punching operation, not only by the hydraulic drive but also by the electrical drive. Thus, the electrical drive can support the punching operation.

The inventive fine blanking system combines the advantages of hydraulic drives and electrical drives for a fine blanking press. Via the electrical drive the press ram 10 can be moved quickly and efficiently when only low forces are needed, which is when approaching the working table/the sheet metal, while via the hydraulic drive the press ram can be moved with a high force in order to execute the punching operation. After the punching the press ram 10 can again be driven via the electrical drive and therefore be retracted quickly and efficiently.

REFERENCE NUMERAL LIST

10 press ram
12 working table
14 fine blanking tool
16 press punch
18 die
20 table cushion
22 transfer pins
24 electrical drive
26 transmission
28 hydraulic drive
30 piston rod
32 sheet metal
34 V-ring
M movement axis

The invention claimed is:

1. A fine blanking system comprising:
a plurality of system components, wherein the plurality of system components comprise:
a press ram,
a press punch, and
a lower die mounted to the press ram;
a first drive comprising a first drive type and configured to directly drive the press ram, wherein the first drive type comprises an electrical drive; and
a second drive comprising a second drive type and configured to directly drive the press ram, wherein the second drive comprises one of a pneumatic drive and a hydraulic drive,
wherein the electrical drive, the pneumatic drive and the hydraulic drive are different drive types from each other,
wherein the second drive type is a different drive type from the first drive type,
wherein the first drive and the second drive are configured to independently or jointly lift or lower the press ram.

2. The fine blanking system according to claim 1, wherein the first drive is configured to drive the press ram at first rate and the second drive is configured to drive the press ram at a second rate that is different from the first rate.

3. The fine blanking system according to claim 2, wherein the first and second rates comprise at least one of respectively speeds, accelerations, and forces.

4. The fine blanking system according to claim 1, further comprising working table, wherein the first drive is a first press drive and the second drive is a second press drive configured to drive the press ram in a driving movement towards the working table along a movement axis.

5. The fine blanking system according to claim 4, wherein the first press drive is configured to drive the press ram along a first portion of the movement axis to approach the working table, and wherein the second press drive is configured to drive the press ram along a second portion of the movement axis to fine blank a work piece positioned between the press ram and the working table.

6. The fine blanking system according to claim 5, wherein the first press drive is configured to drive the press ram in an opposite direction along at least one of the first portion and the second portion of the movement axis to withdraw the press ram from the working table.

7. The fine blanking system according to claim 1, further comprising at least one of a feeding device, a levelling device, a grinding device, a surface treatment device, a press device, a fine blanking press, a parts feeding device, a deburring device, a washing device, a tumbler device, an assembling device, a robotic device, a handling device, a packaging device, a labelling device, and a quality inspection device.

8. A method for operating a fine blanking system comprising a plurality of components, the method comprising:
configuring the plurality of components to comprise:
a press ram,
a press punch, and
a die mounted to the press ram;

driving the press ram directly via a first drive, wherein the first drive comprises a first drive type;

driving the press ram directly via a second drive, wherein the second drive comprises a second drive type that is a different drive type from the first drive type;

structuring the first drive type to comprise an electrical drive; and structuring the second drive type to comprise one of a pneumatic drive and a hydraulic drive, wherein the pneumatic drive, the hydraulic drive, and the electrical drive are different drive types from each other, wherein the first drive and the second drive are configured to independently or jointly lift or lower the press ram.

9. The method according to claim 8, wherein the first drive is configured to drive the press ram at a first rate, and the second drive is configured to drive the press ram at a second rate.

10. The method according to claim 9, wherein the first rate and the second rate comprise one of respectively speeds, accelerations, and forces.

11. The method according to claim 9, further comprising a working table, wherein the first drive is a first press drive and the second drive is a second press drive configured to drive the press ram in a driving movement towards the working table along a movement axis.

12. The method according to claim 11, further comprising:

driving the press ram via the first press drive along a first portion of the movement axis towards the working table; and driving the press ram via the second press drive along a second portion of the movement axis towards the working table to fine blank a work piece positioned between the press ram and the working table.

13. The method according to claim 12, further comprising driving the press ram via the first press drive in an opposite direction along at least one of the first portion and the second portion of the movement axis to withdraw the press ram from the working table.

* * * * *